US005314345A

United States Patent [19]

Cahaly et al.

[11] Patent Number: 5,314,345

[45] Date of Patent: May 24, 1994

[54] ELECTRICAL CONNECTION SYSTEM WITH INTERLOCK

[75] Inventors: James E. Cahaly, Milford, N.H.; Brian R. Pitstick, Mesa, Ariz.

[73] Assignee: TRW Inc., Cleveland, Ohio

[21] Appl. No.: 960,474

[22] Filed: Oct. 9, 1992

[51] Int. Cl.[5] ..... H01R 29/00

[52] U.S. Cl. ..... 439/188; 439/352; 200/51.09

[58] Field of Search ..... 439/188, 352, 353, 357; 200/51 R, 51.09, 51.1

[56] References Cited

U.S. PATENT DOCUMENTS

| | | | |
|---|---|---|---|
| 3,370,140 | 2/1968 | Betts . | |
| 3,467,940 | 9/1969 | Wallo . | |
| 3,512,043 | 5/1970 | Jaaksoo et al. . | |
| 3,912,889 | 10/1975 | Bright . | |
| 4,070,557 | 1/1978 | Ostapovitch . | |
| 4,106,074 | 8/1978 | Conne . | |
| 4,170,939 | 10/1979 | Hoheisel et al. . | |
| 4,185,881 | 1/1980 | Foley et al. | 439/188 |
| 4,271,453 | 6/1981 | Yajima et al. . | |
| 4,358,135 | 11/1982 | Tsuge et al. . | |
| 4,369,707 | 1/1983 | Budde . | |
| 4,634,204 | 1/1987 | Detter et al. | 439/352 X |
| 4,786,258 | 11/1988 | Shaffer et al. | 439/188 |
| 4,904,196 | 2/1990 | Sueyoshi et al. | 439/188 |
| 4,915,642 | 4/1990 | Lin et al. | 439/352 |
| 4,984,998 | 1/1991 | Duncan et al. | 439/595 X |

OTHER PUBLICATIONS

IBM Technical Disclosure Bulletin, vol. 7, No. 6 of Nov. 1964.

*Primary Examiner*—Larry I. Schwartz
*Assistant Examiner*—Khiem Nguyen
*Attorney, Agent, or Firm*—Fay, Sharpe, Beall, Fagan, Minnich & McKee

[57] ABSTRACT

An electrical connection system comprises a first component carrying a pair of male connector elements releasably mated with a pair of female connector elements carried by a second connector component. A shorting clip is associated with the first component for providing an electrical short between the male connector elements. The shorting clip is moved to a non-shorting position when the first component is mated with the second component. An interlock is associated with the system and includes a lock element which is inserted into the connection to prevent separation of the first and second components while the lock element is in position.

19 Claims, 4 Drawing Sheets

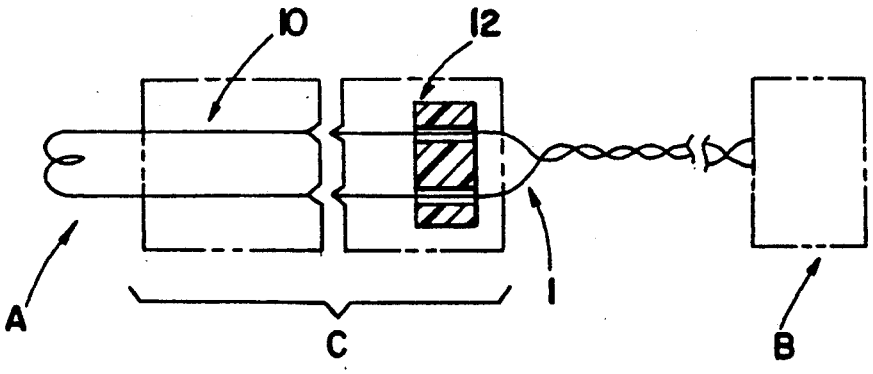
Fig. 1
Fig. 1A
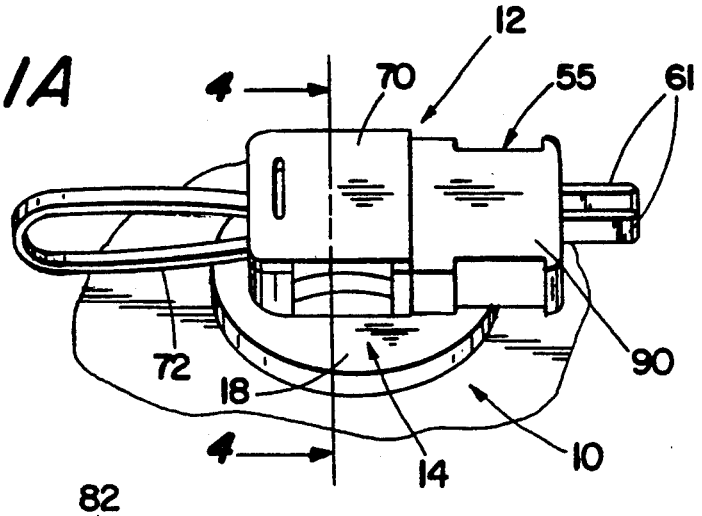
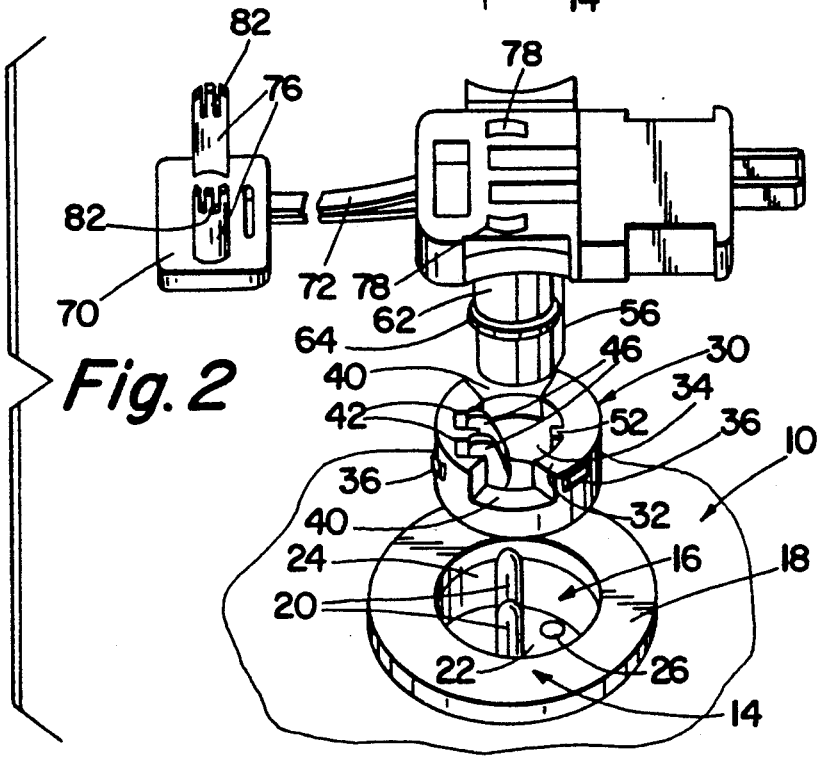
Fig. 2

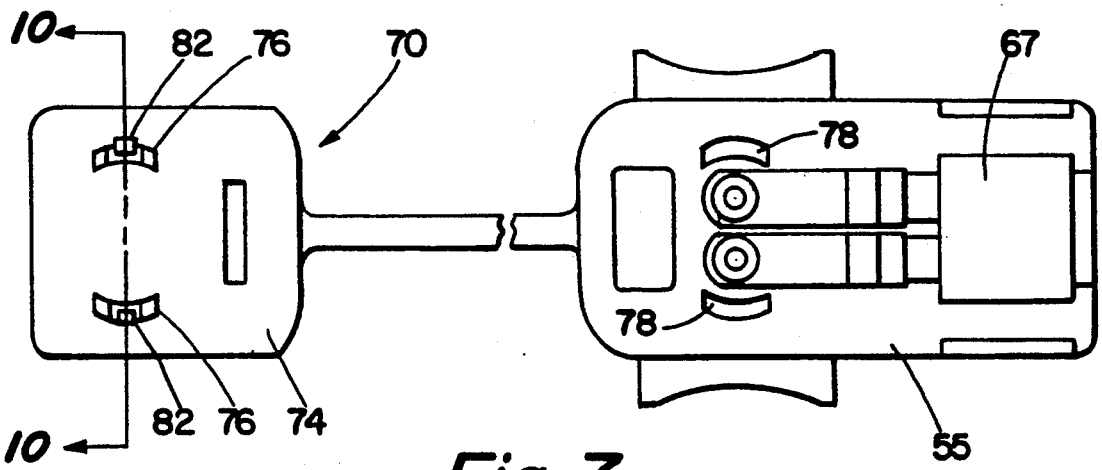
Fig. 7
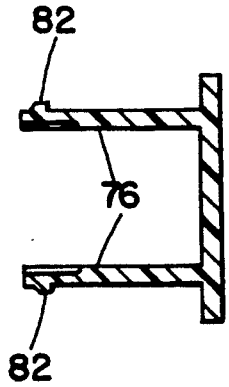
Fig. 10
Fig. 13
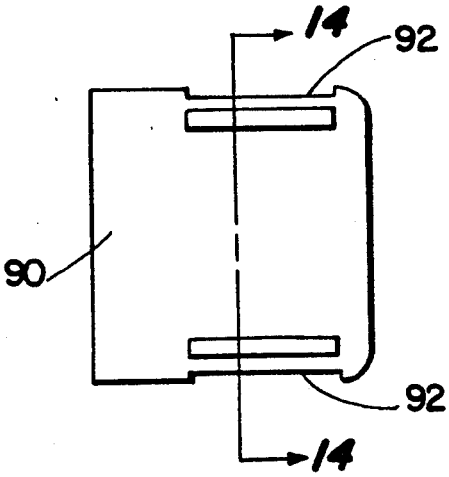
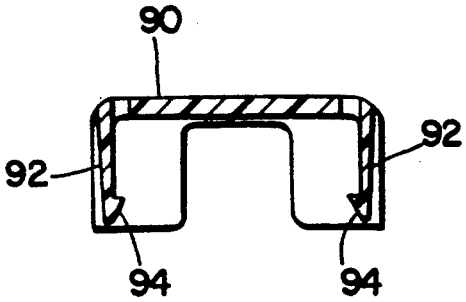
Fig. 14

ELECTRICAL CONNECTION SYSTEM WITH INTERLOCK

BACKGROUND OF THE INVENTION

The subject invention is directed toward the art of electrical connection systems and, more particularly, to an electrical connector arrangement wherein the electrical contacts of one component are shorted together when proper electrical connection to a second component has not been made.

The invention is particularly suited for use in vehicle occupant inflatable restraint ("airbag") systems and will be described with reference thereto; however, the invention is capable of broader application and could be used in many different environments and for a variety of purposes.

Vehicle inflatable restraint, or "airbag", systems each include an airbag assembly mounted in a hidden compartment within the cab of the vehicle and an electrical or electronic control system. The control system is connected to the airbag assembly by means of a wiring harness which typically is provided with an electrical plug and jack connector arrangement to permit an easy method of electrically joining the airbag assembly and the control system after they have been installed separately.

U.S. Pat. Nos. 4,988,307 (Muzslay), 4,906,203 (Margrave, et al.), 4,369,707 (Budde), and 4,170,939 (Hoheisel, et al.) each discloses a connection system for use in an airbag system. Each connection system incorporates a so-called shorting clip. Shorting clips are small metal elements arranged to electrically short together the leads within the plug or jack before the plug and jack are mated. Such shorting clips are included as a safety feature, to preclude stray electrical charges and inadvertent misconnections from accidentally triggering the airbag assembly during the manufacturing process.

SUMMARY OF THE INVENTION

The subject invention provides an electrical connection system including a locking element. The locking element is designed for insertion into the connected components to provide a positive mechanical interlock and thereby prevent inadvertent disconnection of the components.

The connection system of the invention is simple and effective and provides a ready visual indication as to whether or not proper mechanical and electrical connection has been made.

In accordance with the subject invention, an electrical connection system is provided which includes a first component carrying a first connector element. A shorting element is associated with the first component and includes a contact element biased into electrical contact for shorting out the first connector element. A second component is provided which has a body releasably matable with the first component. The second component carries a second connector element which is engagable with the first connector element. A portion of the body is contoured to enter between the contact element and the first connector element to disconnect the electrical short upon mating of the second component with the first component. Disposed in this position, the contoured body portion opens the shorting element permitting electrical communication through said first connector element. Resilient latch means are carried by at least one of the first and second components for providing a mechanical latch with the other component. Additionally, a locking element is provided which is insertable into a lock position in the mated first and second components for preventing release of the latch means and preventing separation of the first and second components while in the lock position.

Preferably, and in accordance with a more limited aspect of the invention, the locking element is carried by the second component and enters into an opening in the second component to maintain the resilient latch means forced into engagement with the first component.

In accordance with a further aspect of the invention, the body of the second component is received in a socket formed in the first component. The resilient latch means include a latch element which is associated with the first component and is received in a latch groove formed about the interior of the socket. The locking element preferably is movable to a position wherein the resilient latch means is prevented from moving away from the latch groove.

In accordance with a further aspect of the invention, the locking element includes a portion which is visible from the exterior of the assembled connection system so as to provide a visual indication as to whether or not proper mechanical and electrical connection has been made. Preferably, the locking element is tethered to the second component.

As can be seen from the foregoing, a primary object of the invention is the provision of an electrical connection system of the type described wherein an interlocking means is provided which is an integral part of the system and that functions to prevent inadvertent disconnection of the primary connector components.

Yet another, more limited object of the invention is the provision of an interlocking system of the general type described wherein the locking element enters into the connected components to prevent inadvertent disconnection.

A further object of the invention is the provision of a system of the type described wherein a shorting element functions to automatically short out the connector elements upon disconnection of the components.

BRIEF DESCRIPTION OF THE DRAWINGS

The above and other objects and advantages will become apparent from the following description when read in conjunction with the accompanying drawings wherein:

FIG. 1 is an electrical schematic of a vehicle occupant restraint system;

FIG. 1A is an isometric view of the connection system of the FIG. 1 schematic with the component elements in their electrically and mechanically interconnected relationship;

FIG. 2 is an isometric exploded view showing the components of the connection system in proper relative physical orientation but in a mechanically separated and electrically disconnected condition;

FIG. 7 is a top plan view of the second connector component of the system shown in FIG. 1A;

FIG. 10 is a cross-sectional view taken on line 10—10 of FIG. 7;

FIG. 13 is a top plan view of a cover provided on the component shown in FIG. 7; and FIG. 14 is a cross-sectional view taken on line 13—13 of FIG. 12.

DETAILED DESCRIPTION OF THE PREFERRED EMBODIMENT

Figure 3:
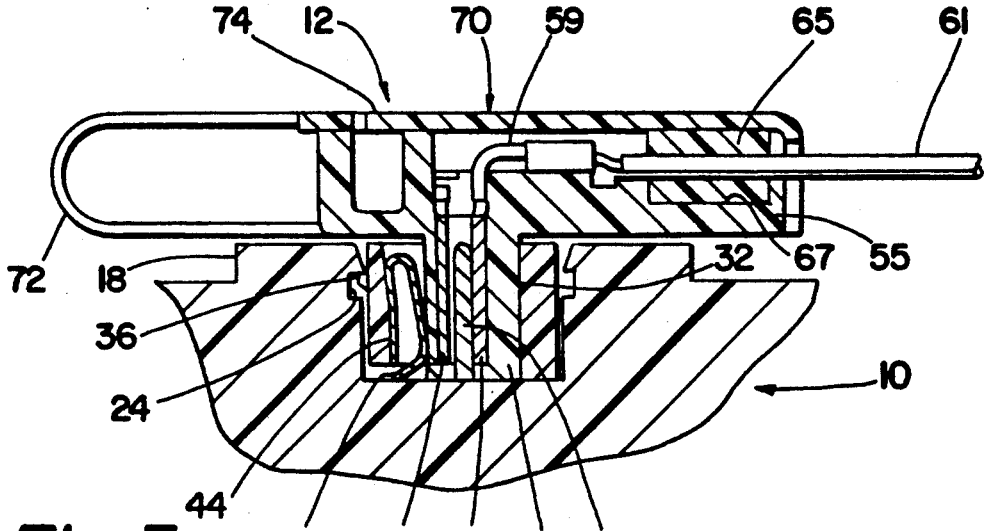
FIG. 3 is a vertical cross-sectional view taken on line 3—3 of FIG. 1A.

Referring more particularly to the drawings wherein the showings are for the purpose of illustrating a preferred embodiment of the invention only, and not for the purpose of limiting same, FIG. 1 is a general electrical schematic of a vehicular occupant restraint system in which the connector of the present invention will find utility. As shown in this FIGURE, the system comprises an airbag igniter A (sometimes referred to as a squib) which must be electrically coupled to a control system B. The igniter A is a pyrotechnic device which will combust when sufficient electrical energy is applied to it via its two electrical leads. Combustion of the igniter causes ignition of a gas generant material and consequent deployment of the airbag.

The control system is an arrangement of mechanical, electrical, and/or electronic elements designed to discern when the airbag should be deployed, and to then promptly apply electrical energy to the igniter to initiate the deployment. Electrical energy is coupled between the control system and the igniter via a pair of wires 1 and a connector system c. The connector system C includes plug and jack components which may be mated to complete the electrical connection between the wires 1 and igniter A.

FIG. 1A shows the overall arrangement of the connector system C of the subject invention in a connected and mated condition and comprising a first component 10 into which a second component 12 is mechanically and electrically connected.

Referring in particular to FIG. 2, it will be seen that the first component 10 is a jack which comprises a main body 14 which defines an inwardly extending cylindrical socket 16. The component 10 can be a separate element which is subsequently mechanically and electrically connected to an associated structure or, of course, it can be integrally formed as part of the associated structure such as, for example, an electric igniter or the like. In any event, the body 14 includes a radially extending cylindrical shoulder 18 and the previously-mentioned socket 16. Carried within the socket 16 are a pair of centrally located male electric connector elements or pins 20 that extend perpendicular to the bottom wall 22 of socket 16. The pins are formed of electrically conductive material, but are mounted in electrically insulating material so as to be electrically isolated from one another. The two pins are coupled in any conventional fashion to respective leads of an airbag igniter (not shown) such that the coupling of electrical energy to the igniter through the pins will cause the igniter to fire.

Figure 4:
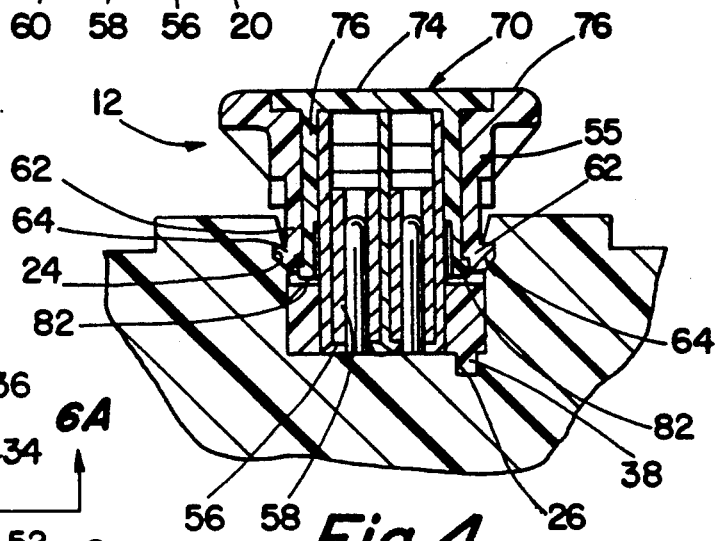
FIG. 4 is a vertical cross-sectional view taken on line 4—4 of FIG. 1A.

Associated with the socket 16 is a circumferentially extending locking groove 24 which has the cross-sectional configuration best seen in FIGS. 3 and 4. The multiple functions of the locking groove 24 will subsequently be described. It should also be noted that the bottom wall 22 includes three inwardly extending circular recesses 26. These recesses provide means for orienting the associated structures in the socket 16.

Closely received in socket 16 and releasably retained therein is a shorting insert 30 that functions to electrically short the male connector elements 20 to one another when component 12 is not in the mated position. Insert 30 generally comprises a plastic cylindrical disk-like main body 32 having a circular through-opening 34 formed therein. As best seen in FIGS. 3 and 4, the shorting insert 30 is positioned in the bottom portion of the socket 16 and includes radially extending locking tabs or latch elements 36 which are positioned to resiliently engage the latch groove 24. These latch tabs 36 thus act to retain the shorting insert in proper position within the socket. In order to assure correct orientation of the shorting insert and proper relationship relative to the male connector elements 20, downwardly extending legs or extensions 38 are provided. The legs or extensions 38 enter into the previously-mentioned recesses 26. For reasons which will subsequently be described, the upper surface of the body 32 is provided with arcuate cutouts 40 which extend downwardly substantially halfway (axially) through body 32.

A shorting clip 42 is retained within the body 32 of the shorting insert 30. The clip 42 is formed of a resilient, electrically conductive material such as spring steel. Portions of the shorting clip 42 are resiliently biased toward engagement with both of the male connector pins 20 establishing an electrical short circuit therebetween.

Figure 5:
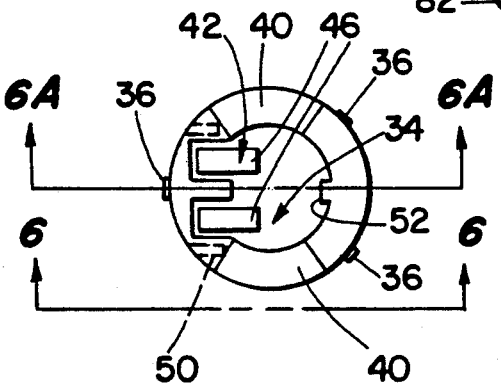
FIG. 5 is a plan view of the shorting element of the connector system.
Figure 5A:
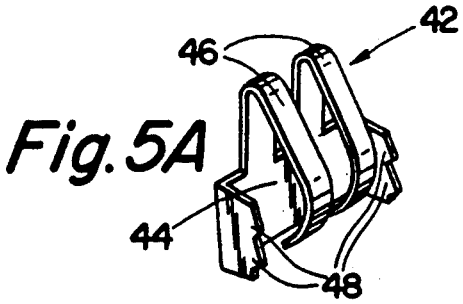
FIG. 5A is an isometric view of the shorting clip used in the shorting element of FIG. 5.
Figure 6:
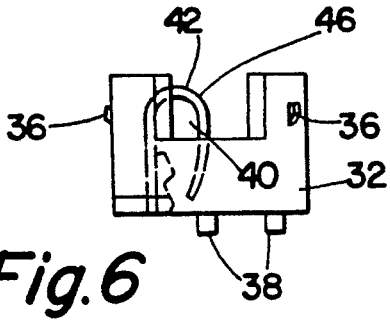
FIG. 6 is a side elevational view of the component shown in FIG. 5 (the view is taken on line 6—6)
Figure 6A:
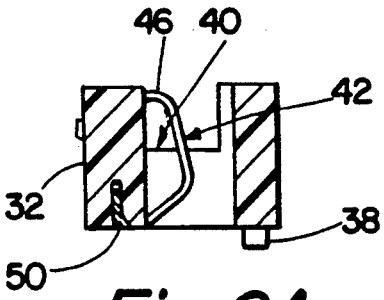
FIG. 6A is a cross-sectional view taken on line 6A—6A of FIG. 5.

As best seen in FIGS. 5 through 7, the shorting clip 42 comprises a base 44 and upwardly extending legs 46. Legs 46 are each bent back towards the base as best shown in FIG. 5A and act to bias into engagement and make respective electrical connection with the sides of both of the connector pins 20. The legs 46 extend generally parallel to the connector pins 20. The base 44 is generally planar and is oriented parallel to the plane of the connector pins 20. The transverse ends of base 44 are serrated and are folded at right angles to thereby form catches. Catches 48 engage the groove 50 on member 30 to retain the shorting clip 42 in position.

Positioned within the central opening or through-opening 34 is an axially extending rib 52. The rib 52 mates with a complementary groove in the second component 12 to assure proper orientation of the second component 12 when connection is made.

The overall construction and arrangement of the second connection component 12 can best be understood by reference to FIGS. 2, 4, and 7 through 11. As shown therein, the second connection component 12 is a plug which includes a main body 55 having a cylindrical extension 56. The cylindrical outer surface of the extension 56 is sized and shaped to be complementary to the size and shape of the cylindrical inner surface of the central opening 34 of the shorting element 30 whereby the extension 56 can be inserted into, and will be closely received by, the central opening 34. The extension 56 carries a pair of female contacts 58. Each of the contacts 58 is a generally cylindrical contact formed of resilient, electrically conductive metal. The contacts 58 are sized and spaced to each receive a corresponding one of the two pins 20 of the jack 10.

As shown in FIG. 3, each contact 58 has a folded, generally L-shaped attachment section 59 for attachment to a corresponding one of two conductors 61. The conductors 61 are insulation-sheathed wires Whose ends are stripped for electrical and mechanical joining to the attachment section of the corresponding contact. The wires are attached to the cylindrical contacts in any conventional manner, usually through crimping of a portion of the attachment section around the bare end of the wires. The conductors pass through a ferrite bead 65 disposed within a cavity 67 in the main body 55 of plug 12. The bead 65 is a generally box-shaped solid and is pierced by two parallel, cylindrical through-holes through which the conductors 61 pass. The conductors emerge from the main body 55 through openings in the rear wall of the cavity 67.

As mentioned above, the extension 56 includes an axially extending groove or recess 63 (see FIG. 9) which is adapted to receive the axial rib 52 within the opening 34. The rib and groove arrangement properly orients the plug 12 with the jack 10. Additionally, the rib and groove arrangement, in conjunction with the previously-mentioned recesses 26 and tabs 38, prevents relative rotation of the connection elements after they are mechanically and electrically mated.

Also extending downwardly from the main body 55 of plug 12, generally parallel to extension 56, is latch means in the form of a pair of spaced legs 62. The legs are each joined at one end to the main body 55 and are at the other end free. The free end of each leg is radially flexible. Further, the free ends of the legs 62 are provided with radial projections or catches 64 located so as to be received in the latch recess 24 of the socket 16. The relationship of the catches 64 to the recess 24 can best be seen in FIGS. 3 and 4.

Referring again to FIGS. 8 and 9, it will be seen that the legs 62 are positioned on diametrically opposite sides of the plug extension 56 and have a generally arcuate or curved configuration so as to closely engage in the socket 16.

Figure 9:
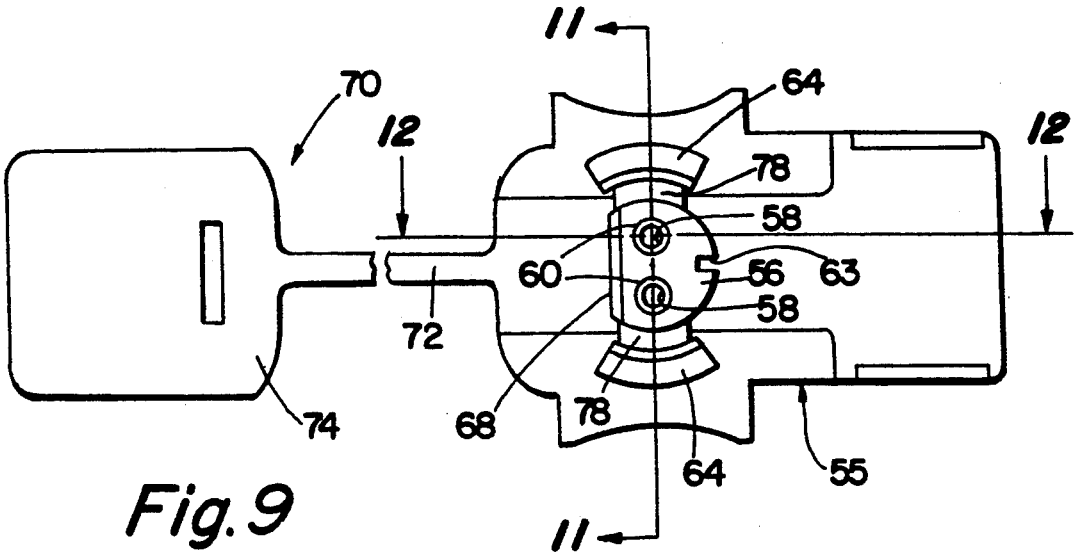
FIG. 9 is a bottom plan view of the component shown in FIG. 7.
Figure 12:
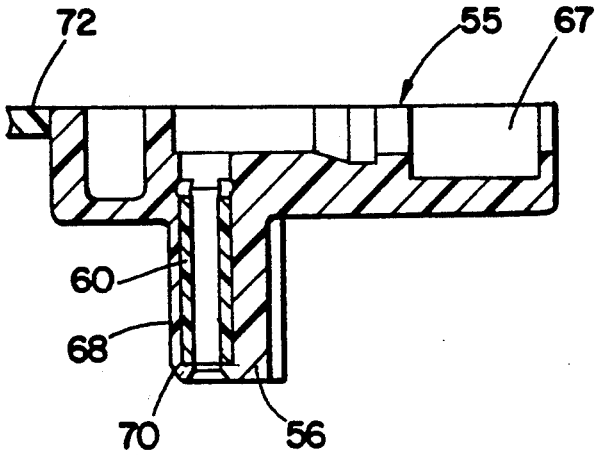
FIG. 12 is a cross-sectional view taken on line 12—12 of FIG. 9.

Plug extension 56 includes a relatively flat side wall 68 that terminates in chamfer 70 best seen in FIGS. 9 and 12. As illustrated in FIG. 3, when the extension 56 is received in opening 34 of the element 30, first the chamfer 70 and then the side wall 68 engages each of the shorting clip legs 46 and forces them away from the respective connector pins 20. This forced retraction of the legs 46 breaks the electrical contact between the clip and the pins, thus removing the short and electrically enabling the connection. Thus, when plug 12 is plugged into jack 10, the electrical short is automatically eliminated. The removal of the short permits electrical energy to be coupled between the pins of the jack 10, the corresponding sockets of plug 12, and conductors 61. When the components are in the connected position, the flexible legs 62 and their catches 64 are engaged in the latch groove 24 as best seen in FIG. 4.

Figure 11:
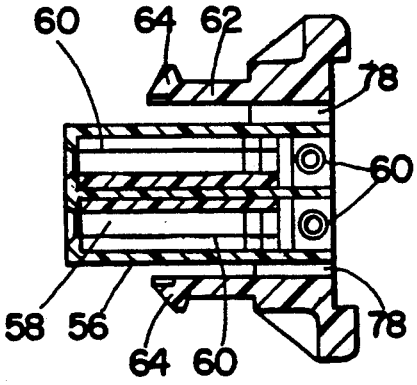
FIG. 11 is a cross-sectional view taken on line 11—11 of FIG. 9.

Preferably, and in accordance with one aspect of the invention, means are provided to lock the legs 62 in their latch position so as to prevent inadvertent disconnection of the connection components 10 and 12. In the subject embodiment, the locking means comprises a locking clip 70 that is connected with the second component 12 by a tether or flexible connecting element 72. The locking clip includes a base 74 and a pair of flexible legs 76 which project from base 74. The legs 76 are sized and shaped so as to extend into openings 78 formed through body 55 and enter between the latch legs 62 and the central portion of plug extension 56. This relationship is best seen in FIGS. 4, 9, and 11. As shown therein, when the locking clip legs 76 are in position, flexure of the legs 62 is blocked and thus it is not possible to disengage the catches 64 from the groove 24. Thus, plug 12 is mechanically interlocked with jack 10 and the risk of inadvertent detachment is reduced. Additionally, when in this interlocked position, the locking clip 70 is located as illustrated in FIG. 1 and provides a visually perceptible indication that the components are properly locked together.

Preferably, small latch tabs 82 are formed at the ends of the legs 76 to resiliently retain locking clip 70 in position. The latch tabs 82 are positioned and sized so as to engage in suitable latch recesses 84 formed at the inner lower ends of the latch legs 62 (see FIG. 4).

Figure 8:
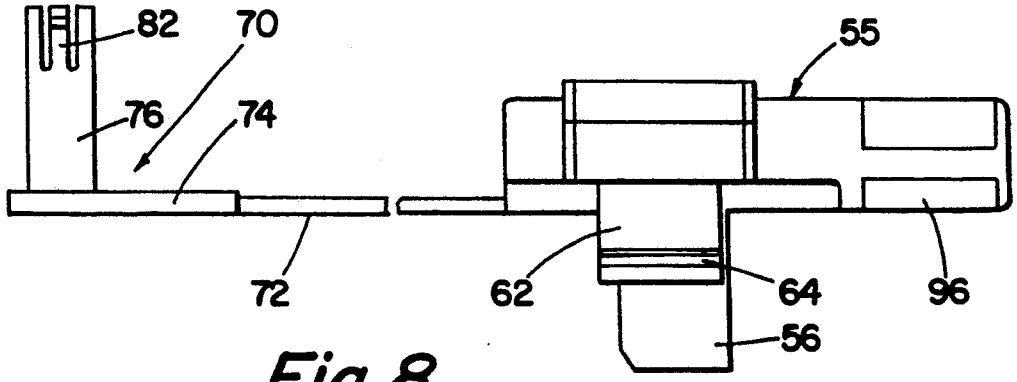
FIG. 8 is a side elevational view of the second connector component shown in FIG. 7.

The plug 12 has its housing or main body 55 completed by a cover 90 (see FIGS. 13 and 14) which is of generally U-shaped configuration and includes downwardly extending resilient sides 92 provided with latches 94. The cover element 90 is sized and arranged to enclose the right-hand end of body 55 as viewed in FIG. 1 and thereby capture the ferrite bead 65 within the cavity 67. The latches 94 engage in suitable recesses 96 located as shown in FIG. 8.

As can be seen from the foregoing, the subject invention provides an effective and simple structure which acts to provide a mechanical and electrical interlock between the various components to prevent inadvertent disconnection. Additionally, with the subject invention, when disconnection does take place, an automatically actuated short is achieved between the male connector elements.

The invention has been described in great detail sufficient to enable one of ordinary skill in the art to make and use the same. Obviously, modifications and alterations of the preferred embodiment will occur to others upon a reading and understanding of the specification. It is my intention to include all such modifications and alterations as part of my invention insofar as they come within the appended claims.

We claim:

1. An electrical connection including:

a) a first component carrying a pair of first connector elements;

b) a shorting element associated with the first component and including a disk-shaped insulative body carrying a pair of shorting contact elements each biased into electrical contact with respective ones of said pair of first connector elements for producing an electrical short therebetween;

c) a second component having a body releasably matable with the first component and carrying a pair of second connector elements engagable with said pair of first connector elements, a portion of the body being contoured to enter into said disk-shaped body to a position between both contact elements of said pair of said shorting contact elements and the pair of first connector elements to disconnect the electrical short upon mating of the second component with the first component;

d) latch means carried by one of the first and second components for providing a mechanical latch with the other component; and, e) a locking element insertable into a lock position in one of the first and second components for preventing release of the latch means and preventing separation of the first and second components while in the lock position.

2. The electrical connection as defined in claim 1 wherein the latch means comprises at least one resilient leg extending from one of the first and second components.

3. The electrical connection as defined in claim 1 wherein one of the first and second components includes a socket into which a portion of the body of the other component is releasably received.

4. The electrical connection as defined in claim 3 wherein the latch means comprises a resilient leg element which extends into the socket into engagement with one of the first and second components and the lock means includes an elongated element insertable into the body of the other component to prevent movement of the resilient leg out of said engagement.

5. The electrical connection as defined in claim 4 wherein the socket includes a latch groove about its interior, the resilient leg element having a latch portion which engages in the latch groove.

6. The electrical connection as defined in claim 3 wherein the disk-shaped body of the shorting element is releasably received in the socket and wherein the shorting element further includes a generally U-shaped shorting clip which has leg portions that define the contact elements and extend parallel to the first connectors.

7. The electrical connection as defined in claim 5 wherein the disk-shaped body includes latch tabs which extend into the said latch groove formed about the interior of the socket.

8. An electrical connection including:

a) a first component carrying a first connector element;

b) a shorting element releasably associated with the first component and including a disk-shaped member carrying a contact element biased into electrical contact with the first connector element for electrically connecting the first connector element to a first electrical potential;

c) a second component having a body releasably matable with the first component and carrying a second connector element engagable with the first connector element, a portion of the body being contoured to enter between the contact element and the first connector element to disconnect the first connector element from the first electrical potential upon mating of the second component with the first component;

d) resilient latch means carried by the second component for providing a mechanical latch with the first component; and, e) a locking element insertable into a lock position in the first component for preventing release of the latch means and preventing separation of the first and second components while in the lock position.

9. An electrical connection as defined in claim 8 wherein the second component carries the locking element.

10. An electrical connection as defined in claim 9 wherein the locking element includes a portion that maintains portions of the latch means in engagement with the first component.

11. An electrical connection as defined in claim 10 wherein the locking element extends into the second element parallel to the first connector element when in the latch position.

12. An electrical connection as defined in claim 8 wherein the first component includes a socket which receives the first component.

13. An electrical connection as defined in claim 12 wherein the body of the second component is received in the socket.

14. An electro-mechanical connector for use with an electrical apparatus having a first pair of electrical contacts for electrical communication with said apparatus, said connector comprising:

a first insulative housing of disk shape removably positioned about said first pair of electrical contacts and carrying electrical conducting means thereon for selectively electrically connecting said first pair of electrical contacts when in a first position and electrically disconnecting from said first pair of electrical contacts when in a second position;

means on said first housing for biasing said electrical conducting means into said first position;

a second housing adapted for releasable mating with said electrical apparatus and carrying a second pair of electrical contacts adapted to engage said first pair of electrical contacts for selective electrical communication with said electrical apparatus, a portion of said second housing entering into said first housing and being adapted for urging said electrical conducting means into said second position against said biasing means when said second housing is mated with said electrical apparatus;

resilient latch means on said second housing adapted for providing a mechanical latch with said electrical apparatus; and, a locking element positionable into a lock position in said second housing for preventing release of said latch means and preventing separation of the first and second housings from said electrical apparatus.

15. The electro-mechanical connector according to claim 14 wherein said second housing includes a plug insertable into a corresponding socket in said electrical apparatus for releasable connection therewith.

16. The electro-mechanical connector according to claim 15 wherein:

said latch means comprises a resilient leg element which extends from the plug into engagement with said electrical apparatus; and, said locking element includes an elongated element insertable into the second housing to prevent movement of said resilient leg out of engagement with said electrical apparatus.

17. The electro-mechanical connector according to claim 16 wherein said socket includes a latch groove about its interior, the resilient leg element having a latch portion which engages in the latch groove and said first housing releasably secured in said socket and having latch elements engaging the latch groove.

18. An electrical connection including:

a) a first component carrying a pair of first connector elements;

b) a shorting element associated with the first component and including a disk-shaped insulative body carrying a pair of contact elements each biased into electrical contact with respective ones of said pair of first connector elements for producing an electrical short therebetween;

c) a second component having a body releasably matable with the first component and carrying a pair of second connector elements engagable with said pair of first connector elements, a portion of the body being contoured to enter between both contact elements of said pair of said shorting elements and the pair of first connector elements to disconnect the electrical short upon mating of the second component with the first component;

d) resilient latch means carried by one of the first and second components for providing a mechanical latch with the other component;

e) a locking element insertable into a lock position in one of the first and second components for preventing release of the latch means and preventing separation of the first and second components while in the lock position;

f) one of the first and second components including a socket into which a portion of the body of the other component is releasably received; and, g) the disk-shaped insulative body of the shorting element being releasably received in the socket and the shorting element further including a generally U-shaped shorting clip which has leg portions that define the pair of contact elements and extend parallel to the first connector elements, said first connector elements extending through the disk-shaped insulative body.

19. The electrical connection as defined in claim 18 wherein the disk-shaped body includes latch tabs which extend into a latch groove formed about the interior of the socket.

* * * * *